US008127388B2

(12) United States Patent
Watchorn et al.

(10) Patent No.: US 8,127,388 B2
(45) Date of Patent: Mar. 6, 2012

(54) GANGWAY APPARATUS

(75) Inventors: Michael John Watchorn, Stocksfield (GB); Andrew James Eaton, Leadgate (GB)

(73) Assignee: IHC Engineering Business Limited (GB)

( * ) Notice: Subject to any disclaimer, the term of this patent is extended or adjusted under 35 U.S.C. 154(b) by 0 days.

(21) Appl. No.: 11/997,395

(22) PCT Filed: Jul. 31, 2006

(86) PCT No.: PCT/GB2006/002860

§ 371 (c)(1), (2), (4) Date: Mar. 19, 2008

(87) PCT Pub. No.: WO2007/015079

PCT Pub. Date: Feb. 8, 2007

(65) Prior Publication Data

US 2008/0229524 A1 Sep. 25, 2008

(30) Foreign Application Priority Data

Aug. 1, 2005 (GB) ..... 0515800.1

(51) Int. Cl.
*B63B 27/14* (2006.01)

(52) U.S. Cl. ..... 14/2.6; 14/71.1; 14/71.5

(58) Field of Classification Search ..... 14/2.5, 14/2.6, 69.5, 71.1, 71.5; 405/195.1; *B63B 27/14*
See application file for complete search history.

(56) References Cited

U.S. PATENT DOCUMENTS 233,159 A * 10/1880 Mooney ..... 14/69.5
259,685 A * 6/1882 Haven et al. ..... 14/69.5
555,542 A * 3/1896 Throop ..... 14/69.5
1,378,948 A 5/1921 Hage
1,759,105 A 5/1930 Evans
2,527,653 A 10/1950 Pierce
2,896,564 A 7/1959 Wright
2,955,299 A 10/1960 Ingram, Jr.
3,004,391 A * 10/1961 Miller ..... 405/219
3,008,158 A * 11/1961 Stinson ..... 14/71.1
3,152,568 A 10/1964 Mayer
3,216,639 A 11/1965 Castela (Continued)

FOREIGN PATENT DOCUMENTS

CH 241601 3/1946

(Continued)

OTHER PUBLICATIONS

International Preliminary Report on Patentability Chapter I for WO/2007/015079.

(Continued)

*Primary Examiner* — Gary S Hartmann
(74) *Attorney, Agent, or Firm* — Ryan A. Schneider, Esq.; Troutman Sanders LLP

(57) ABSTRACT

A gangway apparatus (10) for transfer between vessels or between a vessel (38) and a fixed structure such as an offshore construction or a quay is disclosed. The gangway apparatus (10) includes a gangway component (16) which is preferably buoyant and may be inflatable. The gangway component (16) is mounted on a skate or bogie and traverses a fixedly mounted runway (14). The runway (14) may be inclined. Control means are provided for controlling the motion of the gangway component on the runway. These may include biasing means such as a counterweight. The apparatus is preferably mounted in a shipping container such as a 40' ISO container.

20 Claims, 5 Drawing Sheets

U.S. PATENT DOCUMENTS

| | | | | | |
|---|---|---|---|---|---|
| 3,237,414 | A | | 3/1966 | Straub et al. | |
| 3,372,849 | A | | 3/1968 | Hall et al. | |
| 3,503,512 | A | | 3/1970 | Desty et al. | |
| 3,589,580 | A | | 6/1971 | Smulders | |
| 3,608,316 | A | | 9/1971 | Manuel | |
| 3,638,288 | A | | 2/1972 | Pryor | |
| 3,692,144 | A | * | 9/1972 | Summer et al. | 182/48 |
| 3,716,994 | A | | 2/1973 | Pogonowski | |
| 3,739,971 | A | | 6/1973 | Silvestri et al. | |
| 3,747,354 | A | * | 7/1973 | Macomber | 405/220 |
| 3,788,396 | A | | 1/1974 | Shatto, Jr. et al. | |
| 3,808,625 | A | | 5/1974 | Fowler | |
| 4,027,486 | A | | 6/1977 | Dougherty | |
| 4,073,155 | A | | 2/1978 | Schiemichen | |
| 4,083,072 | A | * | 4/1978 | Ryan | 14/69.5 |
| 4,133,067 | A | * | 1/1979 | Bennett et al. | 14/71.3 |
| 4,133,283 | A | | 1/1979 | Ryan | |
| 4,162,551 | A | * | 7/1979 | Serrano | 14/69.5 |
| 4,169,296 | A | * | 10/1979 | Wipkink et al. | 14/71.1 |
| 4,222,683 | A | | 9/1980 | Schaloske et al. | |
| 4,285,454 | A | | 8/1981 | Plumettaz | |
| 4,286,346 | A | | 9/1981 | Wiek | |
| 4,333,196 | A | * | 6/1982 | Bougaran | 14/71.7 |
| 4,363,150 | A | * | 12/1982 | Nilsson | 14/69.5 |
| 4,366,591 | A | * | 1/1983 | Zimmerman | 14/71.3 |
| 4,369,538 | A | * | 1/1983 | Smedal | 14/69.5 |
| 4,406,094 | A | | 9/1983 | Hempel et al. | |
| 4,459,931 | A | | 7/1984 | Glidden | |
| 4,521,132 | A | | 6/1985 | Isakson et al. | |
| 4,581,784 | A | | 4/1986 | Rousseau et al. | |
| 4,590,634 | A | * | 5/1986 | Williams | 14/71.1 |
| 4,596,494 | A | | 6/1986 | Manesse et al. | |
| 4,602,697 | A | * | 7/1986 | Aanensen | 182/48 |
| 4,611,953 | A | | 9/1986 | Owens | |
| 4,655,641 | A | | 4/1987 | Weyler | |
| 4,720,214 | A | | 1/1988 | Brasted et al. | |
| 4,721,412 | A | | 1/1988 | King et al. | |
| 4,744,698 | A | | 5/1988 | Dallimer et al. | |
| 4,789,271 | A | | 12/1988 | Sullaway et al. | |
| 4,869,615 | A | | 9/1989 | Galle | |
| 4,872,782 | A | | 10/1989 | Streichenberger | |
| 4,902,169 | A | | 2/1990 | Sutton | |
| 4,917,540 | A | | 4/1990 | Recalde | |
| 5,020,940 | A | | 6/1991 | Smith | |
| 5,126,134 | A | | 6/1992 | Heim et al. | |
| 5,263,624 | A | | 11/1993 | Zuidberg | |
| 5,800,093 | A | | 9/1998 | Khachaturian | |
| 5,860,379 | A | | 1/1999 | Moody | |
| 5,893,682 | A | | 4/1999 | Oliveri | |
| 5,950,267 | A | | 9/1999 | Ricci, Jr. | |
| 6,131,224 | A | | 10/2000 | Bernal | |
| 6,131,528 | A | | 10/2000 | Meek et al. | |
| 6,347,424 | B1 | * | 2/2002 | Vatne | 14/69.5 |
| 6,408,780 | B1 | | 6/2002 | Ozaki et al. | |
| 6,409,428 | B1 | | 6/2002 | Moog | |
| 6,425,441 | B2 | | 7/2002 | Shaaban et al. | |
| 6,425,708 | B1 | | 7/2002 | Siegfriedsen | |
| 6,439,445 | B1 | | 8/2002 | De Groot et al. | |
| 6,592,416 | B1 | | 7/2003 | Hochschild, III | |
| 6,619,432 | B1 | | 9/2003 | Yasui | |
| 6,651,858 | B2 | | 11/2003 | Shen | |
| 6,739,430 | B2 | * | 5/2004 | Hill | 187/245 |
| 6,745,714 | B1 | | 6/2004 | Faber | |
| 6,923,140 | B1 | * | 8/2005 | Cook | 114/362 |
| 7,021,510 | B2 | | 4/2006 | Ellingson | |
| 7,025,332 | B2 | | 4/2006 | Rincoe | |
| 7,103,935 | B2 | | 9/2006 | Hill | |
| 7,112,010 | B1 | | 9/2006 | Geiger | |
| 7,178,708 | B2 | | 2/2007 | Grinsted | |
| 7,234,409 | B2 | | 6/2007 | Hansen | |
| 7,377,412 | B2 | | 5/2008 | Grinsted | |
| 7,686,543 | B2 | | 3/2010 | They | |
| 7,950,092 | B2 | * | 5/2011 | Watchorn et al. | 14/2.4 |
| 2001/0040031 | A1 | | 11/2001 | Shaaban et al. | |
| 2002/0083881 | A1 | | 7/2002 | Arias | |
| 2002/0085883 | A1 | | 7/2002 | Meyers et al. | |
| 2003/0182741 | A1 | | 10/2003 | Prins | |
| 2003/0217681 | A1 | | 11/2003 | Funk | |
| 2004/0045226 | A1 | | 3/2004 | Dehlsen et al. | |
| 2004/0115006 | A1 | | 6/2004 | Facey et al. | |
| 2004/0190999 | A1 | | 9/2004 | Wybro et al. | |
| 2005/0158125 | A1 | | 7/2005 | Thomas et al. | |
| 2005/0179019 | A1 | | 8/2005 | Ellingson | |
| 2005/0286979 | A1 | | 12/2005 | Watchorn | |
| 2006/0078385 | A1 | | 4/2006 | Watchorn | |
| 2006/0086305 | A1 | | 4/2006 | Merchant et al. | |
| 2006/0120809 | A1 | | 6/2006 | Ingram et al. | |
| 2006/0153644 | A1 | | 7/2006 | Grinsted | |
| 2006/0208245 | A1 | | 9/2006 | Diehl | |
| 2007/0119896 | A1 | | 5/2007 | Grinsted | |
| 2008/0145149 | A1 | | 6/2008 | Grinsted et al. | |
| 2008/0188148 | A1 | | 8/2008 | Simon-Bouhet | |
| 2008/0240863 | A1 | | 10/2008 | Altman et al. | |
| 2008/0247827 | A1 | | 10/2008 | Altman et al. | |
| 2008/0289126 | A1 | | 11/2008 | Stapel | |
| 2008/0301888 | A1 | | 12/2008 | Watchorn et al. | |
| 2009/0028647 | A1 | | 1/2009 | Bingham et al. | |
| 2009/0050045 | A1 | | 2/2009 | Grimaldi | |
| 2009/0191002 | A1 | | 7/2009 | Stubler et al. | |
| 2009/0208294 | A1 | | 8/2009 | Yao et al. | |
| 2010/0143046 | A1 | | 6/2010 | Olsen et al. | |
| 2010/0150660 | A1 | | 6/2010 | Nadarajah et al. | |
| 2010/0224114 | A1 | | 9/2010 | Coppens | |

FOREIGN PATENT DOCUMENTS

| | | | | |
|---|---|---|---|---|
| CH | 363463 | | | 7/1962 |
| DE | 597543 | | | 5/1934 |
| DE | 2341846 | | | 2/1975 |
| DE | 19607972 | | | 1/1998 |
| DE | 10249779 | | | 5/2004 |
| EP | 0255191 | | | 2/1988 |
| EP | 0296272 | | | 12/1988 |
| EP | 0524648 | | | 1/1993 |
| EP | 1101935 | | | 5/2001 |
| EP | 1209028 | | | 5/2002 |
| FR | 2465640 | A | | 3/1981 |
| FR | 2586641 | A2 | | 3/1987 |
| GB | 1136971 | A | | 12/1968 |
| GB | 1236447 | A | | 6/1971 |
| GB | 2001121 | A | | 1/1979 |
| GB | 2033463 | | | 5/1980 |
| GB | 2086313 | | | 5/1982 |
| GB | 2115361 | A | | 9/1983 |
| GB | 2156744 | | | 10/1985 |
| GB | 2158793 | | | 11/1985 |
| GB | 2167714 | A | | 6/1986 |
| GB | 2175332 | | | 11/1986 |
| GB | 2175860 | A | | 12/1986 |
| GB | 2225753 | A | | 6/1990 |
| GB | 2246992 | | | 2/1992 |
| GB | 2390632 | | | 1/2004 |
| JP | 55-91488 | | * | 7/1980 |
| JP | 61211409 | | | 9/1986 |
| JP | 06002317 | | | 1/1994 |
| JP | 2005069025 | | | 3/2005 |
| JP | 2006037397 | | | 2/2006 |
| NL | 1019706 | | | 7/2003 |
| NL | 1023142 | | | 10/2004 |
| SU | 610718 | | | 6/1978 |
| SU | 757383 | | | 8/1980 |
| WO | WO 85/01970 | | | 5/1985 |
| WO | WO 88/03107 | | | 5/1988 |
| WO | 95/14605 | | * | 6/1995 |
| WO | WO 95/14605 | | | 6/1995 |
| WO | WO-9729946 | A | | 8/1997 |
| WO | 2001061114 | A1 | | 8/2001 |
| WO | WO-0220343 | A | | 3/2002 |
| WO | WO 02/48547 | | | 6/2002 |
| WO | WO 03/066426 | | | 8/2003 |
| WO | WO 03/066427 | | | 8/2003 |
| WO | WO 2004/038108 | | | 5/2004 |
| WO | WO 2004/040182 | | | 5/2004 |
| WO | 2004070119 | | | 8/2004 |
| WO | WO 2004/083529 | | | 9/2004 |
| WO | WO 2005/047097 | | | 5/2005 |
| WO | 2006013342 | A1 | | 2/2006 |

| | | |
|---|---|---|
| WO | WO 2006/076920 | 7/2006 |
| WO | WO 2006/087540 | 8/2006 |
| WO | WO 2007/091042 | 8/2007 |

OTHER PUBLICATIONS

Great Britain Search Report dated Apr. 12, 2005 for International Application No. GB0503083.8.
Great Britain Search Report dated Apr. 26, 2006 for British Application No. GB0602503.5.
Great Britain Search Report for related Application No. GB0515800.1 dated Nov. 11, 2005.
Great Britain Examination Report for related Application No. GB0515800.1 dated Dec. 5, 2008.
Great Britain Combined Search and Examination Report for related Application No. GB0807877.6 dated Nov. 10, 2010.
Great Britain Search Report for Application No. GB 0224656.9 Dated Nov. 22, 2002.
Great Britain Search Report for Application No. GB 0225496.9 Dated Apr. 28, 2003.
International Search Report for PCT Application No. PCT/GB03/04529 Dated Feb. 11, 2004.
International Search Report for PCT Application No. PCT/GB03/04697 Dated Apr. 22, 2004.
Great Britain Search Report for Application No. GB 403362.7 Dated Jun. 29, 2004.
International Search Report for PCT Application No. PCT/GB04/01208 Dated Jul. 19, 2004.
International Search Report for PCT Application No. PCT/GB04/04716 Dated Feb. 23, 2005.
International Search Report for PCT Application No. PCT/GB05/03010 Dated Nov. 22, 2005.
International Search Report and Written Opinion for PCT Application No. PCT/GB06/00525 Dated May 19, 2006.
International Search Report and Written Opinion for PCT Application No. PCT/GB06/02860 Dated Oct. 26, 2006.
International Search Report and Written Opinion for PCT Application No. PCT/GB07/00400 Dated Jun. 11, 2007.

* cited by examiner

GANGWAY APPARATUS

BENEFIT CLAIMS

This application is a US National Stage of International Application No. PCT/GB2006/002860, filed 31 Jul. 2006, which claims the benefit of GB 0515800.1, filed 1 Aug. 2005.

FIELD OF THE INVENTION

The present invention relates to apparatus for effecting transfer of personnel, goods and equipment between structures in a marine environment, in particular between a movable vessel and a fixed structure, such as an oil rig or gas rig, a wind turbine, dock or quay, or between one movable vessel and another movable vessel. One particular use is for the transfer of personnel, goods and equipment between a cargo barge and a small service vessel, such as a fast rescue craft.

BACKGROUND OF THE INVENTION

Transfer to and from vessels and fixed structures at sea, or on other large bodies of water, such as larger lakes, is inherently dangerous in particular because of the relative movement between the vessels or between the vessel and the fixed structure. Often, personnel are required to transfer to and from a relatively small vessel, which is subject to movement by waves, wind and tide from and to a vertical ladder of a larger vessel or fixed structure. In the circumstances it is all too easy for untrained or inexperienced personnel to slip or trip and find themselves in the water, where they risk serious injury or drowning. Transfer between larger vessels and vessels of comparable size is no less dangerous. For these reasons, safety regulations limit the transfer of personnel at sea to relatively calm conditions, typically where the maximum wave height is less than 0.7 m. It follows that considerable amounts of working time can be lost due to bad weather conditions, which adds considerable expense to companies operating in the marine environment.

BRIEF SUMMARY OF THE INVENTION

The present invention seeks to address some of the above issues and provide a safe means for transfer of personnel, goods and equipment in the marine environment. The apparatus of the present invention seeks to minimise the effect of relative movement between first and second marine structures (that is, between the two vessels, or between a vessel and a fixed structure), and so allows transfer of personnel, goods and equipment in a greater range of sea conditions. The present invention provides a bridge between the first and second marine structures whereby relative movement between the bridge and respectively the first and second marine structures is minimised. The present invention is also advantageous, in preferred embodiments, in requiring no external power source for its movement in operation.

According to a first aspect of the present invention there is provided an apparatus for providing bridge structure from a first marine structure to a second marine structure, and the apparatus comprising:

i) a gangway component;

ii) a runway on which the gangway component is mounted in a stored condition and along which the gangway component may operatively move between the stored condition and a use condition; and iii) control means operative to control the movement of the gangway component to or from the stored condition.

In preferred embodiments the runway is inclined with respect to the horizontal. The runway may be inclined upwardly or downwardly with respect to the movement of the gangway apparatus from the stored to the use condition, depending for example on the intended final use of the apparatus. Thus, for transfer of people or personnel from a relatively large vessel to a relatively small vessel or to a fixed structure (and when the apparatus is mounted on the relatively large vessel) the runway may be such that the gangway component moves downwardly from the stored condition to the use condition. Conversely, when the apparatus is mounted on a relatively small vessel, and transfer is to a relatively larger vessel or to a fixed structure, the runway may be such that the gangway component moves upwardly from the stored condition to the use condition. The latter examples are, however, not absolute requirements.

Preferably the gangway component is buoyant.

Preferably the gangway component is expandable from a compact condition to an extended condition by inflation thereof.

In a preferred arrangement the gangway component comprises one or more inflatable members. Most preferably the gangway component comprises and outer skin enclosing a plurality of inflatable members.

Preferably the apparatus of the invention further comprises a walkway surface, supported by one or more inflatable members.

In preferred embodiments of the invention, the control means comprises or includes a biasing means. Preferably the biasing means is operative to urge the gangway component towards the stored condition, especially when the runway is inclined such that the gangway component moves downwardly from the stored condition to the use condition. Where the runway is inclined such that the gangway component moves upwardly from the stored condition to the use condition, biasing means may be provided to urge the gangway component towards the use condition.

Preferably the biasing means comprises a counterweight attached to a first end of the gangway component which is an upper end of the gangway component when in the stored condition (for a downwardly inclined runway) or in the use condition (for an upwardly inclined runway)

In preferred variations of the invention the apparatus further comprises fastening means for temporarily fastening the gangway component to the second marine structure.

It is most especially preferred that the apparatus further comprises a container within which at least the gangway component and the control means are mounted. Most preferably in the stored condition, all the principal components of the apparatus are disposed within the container. In the use condition, the gangway component extends from the container.

Preferably the runway is mounted within the container. Preferably also the control means is mounted within the container.

Preferably the container comprises an ISO Standard shipping container.

A second aspect of the invention provides a vessel having mounted thereon apparatus as defined in the first aspect of the invention.

In variations of the invention the apparatus may be mounted on land, such as a quay or jetty or on a fixed offshore structure such as a wind turbine mounting or foundation, an oil or gas rig or the like.

Where the runway is inclined, typically it is inclined at an angle of from about 10° to about 30°.

According to a third aspect of the invention there is provided a method of providing access for the transfer of personnel, goods or equipment from a first marine structure to a second marine structure, the method comprising:

i. providing an apparatus as defined in the first aspect of the invention mounted on the first marine structure;

ii. moving the gangway component along the runway from the stored condition to the extended position so that the gangway component spans the gap between the first and second marine structures; and iii. if necessary, securing the gangway component in the extended position.

Preferably the method further comprises fastening the extended end of the gangway component to the second marine structure.

Preferably the method further comprises providing a winch on the second marine structure, attaching the gangway component to the winch and using the winch to move the gangway component along the runway.

BRIEF DESCRIPTION OF THE DRAWINGS

For a better understanding of the invention and to show how the same may be carried into effect reference will now be made, by way of example only, to the following drawings in which.

DETAILED DESCRIPTION OF PREFERRED EMBODIMENTS

Figure 1:
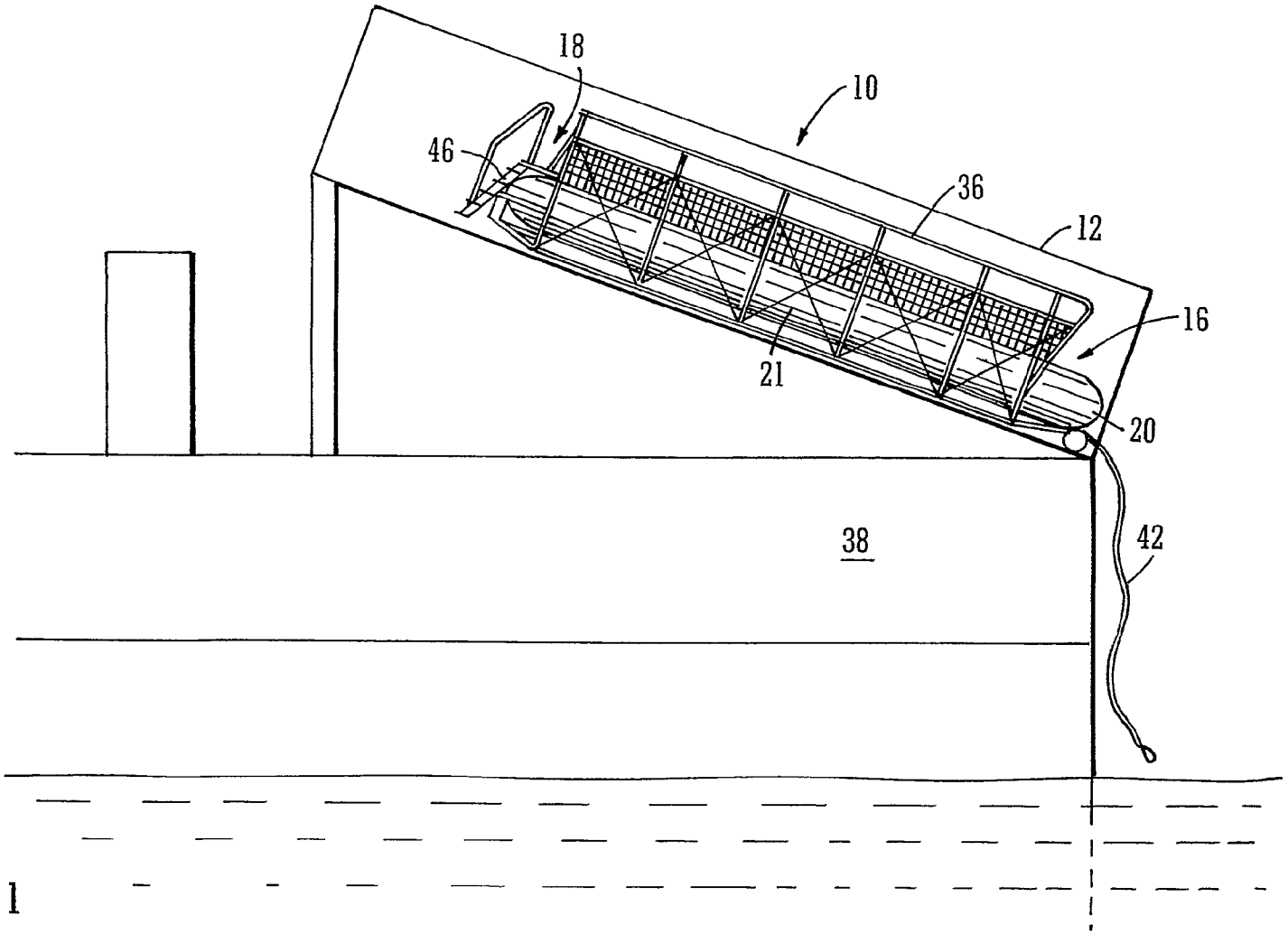
FIG. 1 shows schematically the apparatus of the invention mounted on a barge.

Referring now to the drawings, the illustrated examples of the apparatus 10 relate to the transfer from a relatively large (high sided) vessel 38 to a relatively small vessel. The apparatus 10 includes a runway 14 which is arranged in fixed relation to the vessel. That is, when in its position of use, the runway does not itself move with respect to vessel 38. A gangway component 16 is mounted on the runway 14 in such a way that it may operatively traverse (i.e. move along) the runway 14. In the illustrated example of transfer for a relatively high sided vessel 38 to a relatively small vessel, the runway 14 is arranged to slope downwardly with respect to movement of the gangway component 16 from a stored condition to a use condition. In other situations, such as where the marine structure on which the apparatus of the invention is relatively lower, the reverse may be true, that is, the runway 14 may be inclined upwardly with respect to movement of the gangway component 16 from a stored condition to a use condition.

The apparatus 10 of the invention comprises in the illustrated embodiment a container 12 within which the principal components of the apparatus 10 are disposed. The container 12 is fixedly (but preferably removeably) mounted on the deck or other convenient location of the vessel 38. The container is most preferably a standard shipping container such as an ISO 40' container (that is, a shipping container nominally measuring 40×12 feet (12.2 m×3.7 m). Other ISO sized containers may be used as appropriate. The container 12 is advantageous in protecting principal components of the apparatus from, for example, the environment (weather and sea) when not in use. The container 12 also makes the apparatus of the invention modular—the apparatus 10, contained by the container 12, can be installed primarily as a single unit in a given location (on a first marine structure, primarily on a vessel 38) when required and can be removed as a unit for re-installation elsewhere as and when required.

Within the container 12 is mounted the runway 14, which is preferably inclined at an angle of about 10° to about 30°, preferably about 20° to the horizontal. The gangway component 16 is mounted so as to move on the runway, and in the stored condition illustrated in FIG. 1, the upper end 18 of the gangway component 16 is towards the upper end of the runway 14 and the lower end 20 of the gangway component 16 is towards the lower end of the runway 14. At least the upper end of 18 of the gangway component 16 is attached to the runway by a linkage means 22. The linkage means 22 is free, when required, to traverse the length of the runway 14.

The runway 14 may, for example, comprise one or more rails or, less preferably, may comprise one or more tensioned cables. Preferably, the runway comprises a pair of rails, 24, 26 which are most preferably rectilinear. The linkage means 22 is adapted to slide, roll or otherwise move along the runway 14. For example, the linkage means 22 may comprise a skate, carriage, bogie or truck on which the upper end 18 of the gangway component 16 is mounted. Preferably, the linkage means 22 also includes means to allow rotational freedom for the gangway component 16 with respect to the container 12 and runway 14. Preferably the linkage means 22 allows the gangway component 16 to move left and right with respect to the runway 14 about an axis at or near the upper end 18 of the gangway component 16 and also to move up and down with respect to the runway 14 about an axis at or near the upper end 18 of the gangway component 16.

A biasing means 28 is attached to the gangway component 16, preferably at its upper end 18. The biasing means 28 acts to urge the gangway component 16 to move up the runway, that is, from a use (i.e. extended) condition to the stored condition. Any suitable biasing means 28 may in principle be used, such as a spring system or other mechanical means, or a hydraulic arrangement. Mechanical, electrical or hydraulic drive means may alternatively be used to move the gangway component 16 up the runway 14, but this is less preferred. Preferably, the biasing means 28 comprises a counterweight 30 attached to the upper end 18 of the gangway component 16 by a suitable cable 32. In the preferred arrangement, the biasing means 28 moves on a predetermined track 33 generally parallel to the runway 14. Pulley wheels 35 are provided to accommodate the path of the cable 32. A particular advantage of the counterweight 30 is that it requires no external power source for its operation.

Figure 2C:
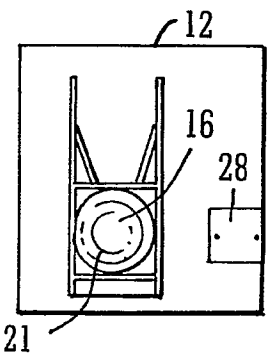
FIGS. 2A, 2B and 2C shows schematically respective plan, side and end views of the apparatus of the invention.
Figure 2A:
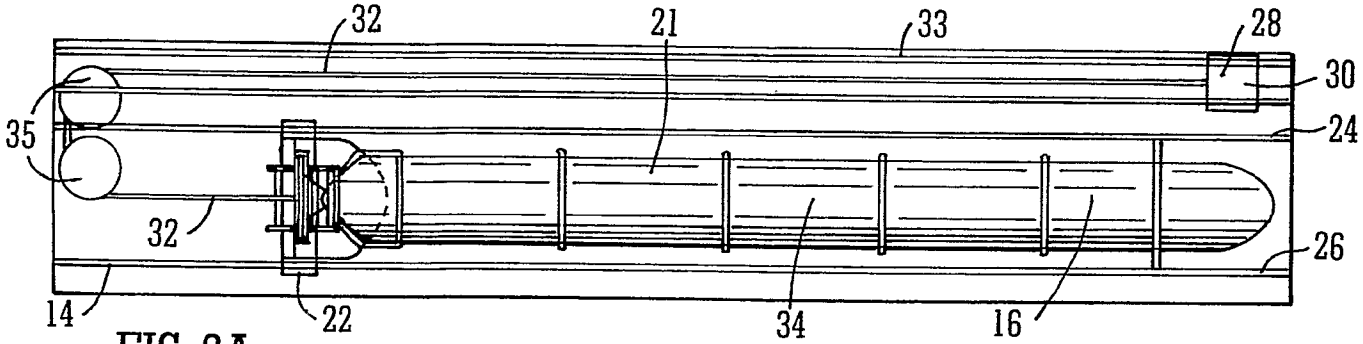
Figure 2B:
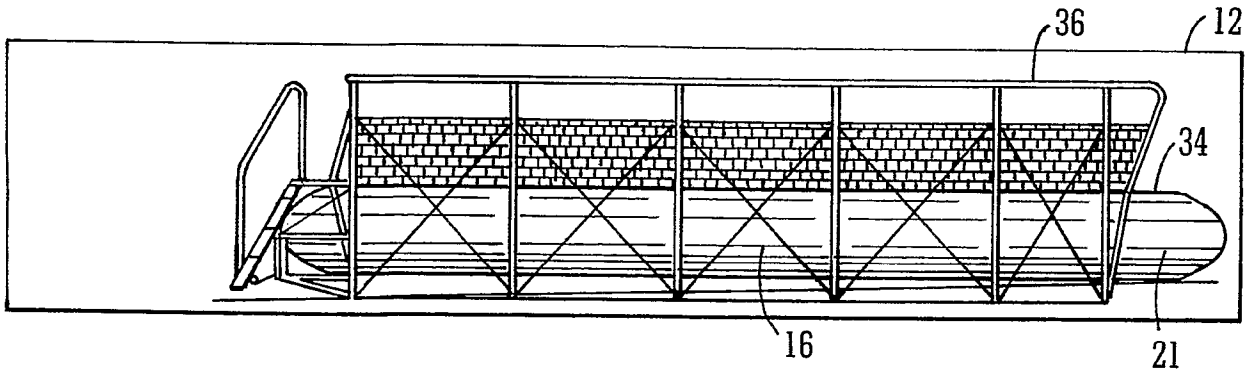

The gangway component 16 of the apparatus of the invention is particularly illustrated FIGS. 2A to 2C. The gangway component 16 preferably comprises a unitary body or unitary assembly so that the complexities and weight disadvantages of, for example, telescopic gangway arrangements or like sub-components which slide relative to one another are avoided. This most preferably when the gangway component 16 is in its use condition (e.g. inflated as noted below) its dimensions are fixed. The gangway component 16 most preferably includes at least one part which imparts buoyancy. In preferred arrangements, the gangway component 16 comprises at least one inflatable member 21. Although a single inflatable member can be used, a plurality of inflatable members is preferred to provide redundancy in case of failure of one of the inflatable members. In a particularly preferred arrangement, the gangway component comprises a plurality of inflatable tubes, which are retained together in a group. Typically, the gangway component 16 comprises about 10 to 20 and especially about 15 inflatable tubes. In the preferred construction, the inflatable tubes are surrounded by an outer skin which, when the tubes are inflated, is approximately circular in cross-section. Thus, if one or two of the inflatable tubes fail, the remaining tubes can expand to fill the space so created and the gangway component 16 remains sufficiently rigid to allow transfer of personnel, goods and equipment across it. In this construction, the outer skin, when the inflatable tubes are inflated, typically has a diameter of approximately 1 m.

In order to provide additional safety for the transfer of personnel, goods and equipment, the gangway component is provided with a walkway surface 34. The walkway surface 34 may be an upper surface of the inflatable member or outer skin, in which case the said surface is preferably provided with anti-slip means such as a high friction layer or coating and/or netting. Alternatively, an additional surface, supported by the inflatable member may be provided. Furthermore, side rails 36 are preferably provided to prevent personnel from falling off the gangway component and to allow them to hold on, as they traverse the gangway component.

As noted above, and the gangway component is most preferably buoyant and the buoyancy is preferably provided by means of one or more inflatable members 21. The advantage of making the gangway component 16 buoyant is described in more detail below. The use of inflatable members 21 has the added advantage that when the apparatus of the invention is not required for use, the inflatable members 21 may be deflated so that the gangway component can be compressed into a compact stored condition.

The inflatable member(s) 21 may be inflated by any suitable inflating fluid, but most preferably air is used. The air may be compressed air stored in suitable compressed air cylinders on the first marine structure or may be provided by a suitable compressor mounted on the first marine structure. Inflation and deflation of the inflatable members 21 typically takes 2 to 3 minutes.

In use of the apparatus 10 of the invention, the gangway component may be maintained in its inflated state throughout a long period of use in one or more locations, or indefinitely. Alternatively, it may be advantageous to inflate and deflate the gangway component 16 respectively before and after each use, or before and after a group of uses close together in time. It can be appreciated that where inflation and deflation of the gangway component 16 is not necessary, the gangway component 16 may be merely buoyant without the facility for inflation and deflation.

Figure 3:
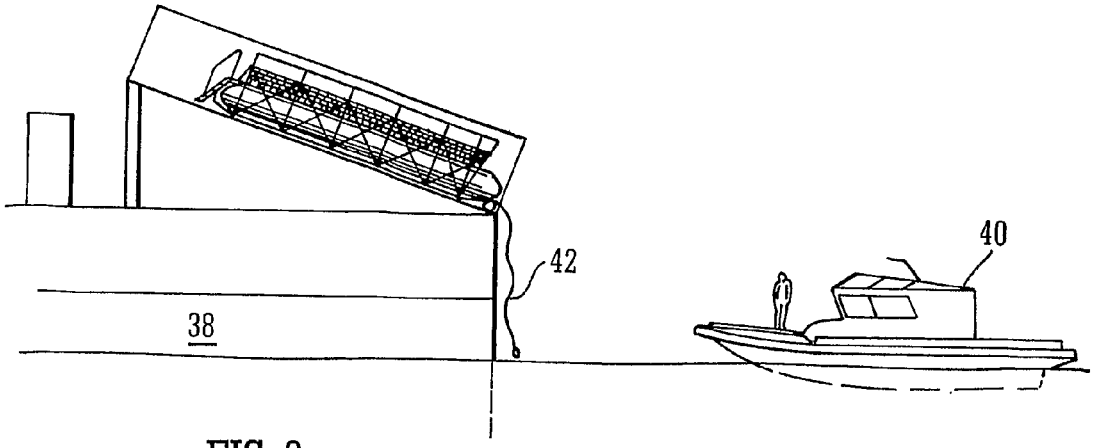
FIG. 3 shows an initial stage in the use of the apparatus of the invention for providing a transfer means to a small vessel.

The method of use of the apparatus 10 of the invention will now be further described. The apparatus 10 is mounted on a first marine structure, which is normally a marine structure of significant size, such as an offshore wind turbine, an oil rig, gas rig or the like or a vessel, such as a construction barge 38. The construction barge 38 is approached by, or approaches, the second marine structure, which is typically (but not necessarily) a smaller boat 40, such as a fast rescue craft, RIB (rigid inflatable boat) or RHIB (rigid hull inflatable boat) (FIG. 3). (Alternatively, the second marine structure can be a fixed structure such as a quay or jetty, or a wind turbine mounting or the like.) Personnel on the smaller boat 40 capture a rope, wire or cable 42 which is then attached to suitable means on the smaller boat 40 for pulling the cable 42. Preferably, said suitable means is a winch, especially a manual capstan winch mounted on the fore deck of the smaller boat 40. The smaller boat 40 and then thrusts away from the barge 38, and the capstan winch is used to pull the cable 42.

In alternative arrangements, means may be provided on the first marine structure (e.g. barge 38) for allowing the gangway component 16 to move down the runway 14, against the action of the biasing means. For example means, such as a winch and cable, may be provided for the controlled raising (and subsequent lowering) of the counterweight 30. In further alternative arrangements, where the runway is upwardly inclined, the biasing means may be used to move, or to assist in moving, the gangway component to its extended condition.

Figure 4A:
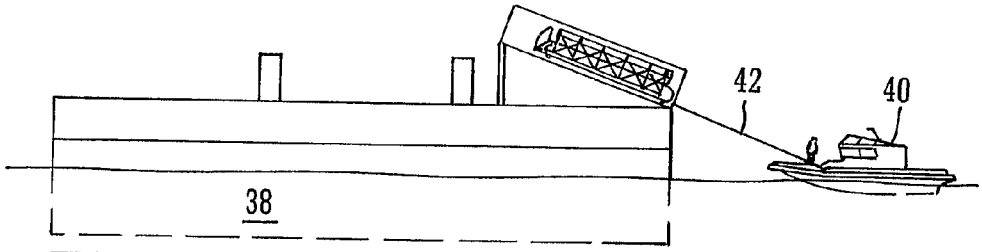
FIGS. 4A, 4B, and 4C show subsequent stages in the use of the apparatus of the invention for providing transfer means to a small vessel.
Figure 4B:
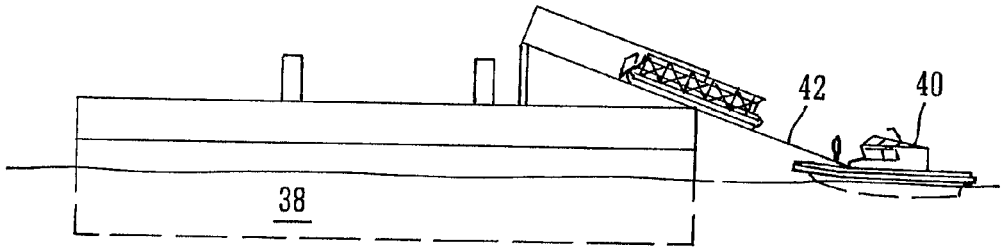
Figure 4C:
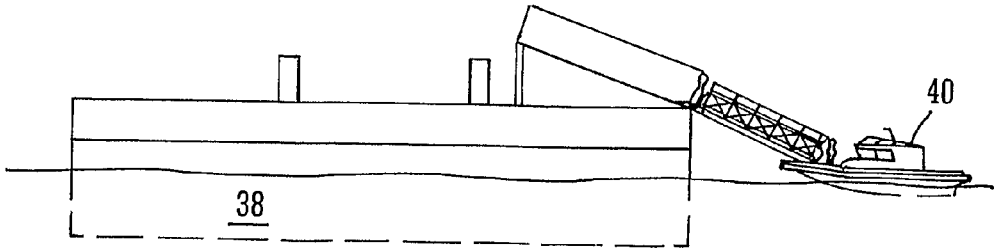
Figure 5:
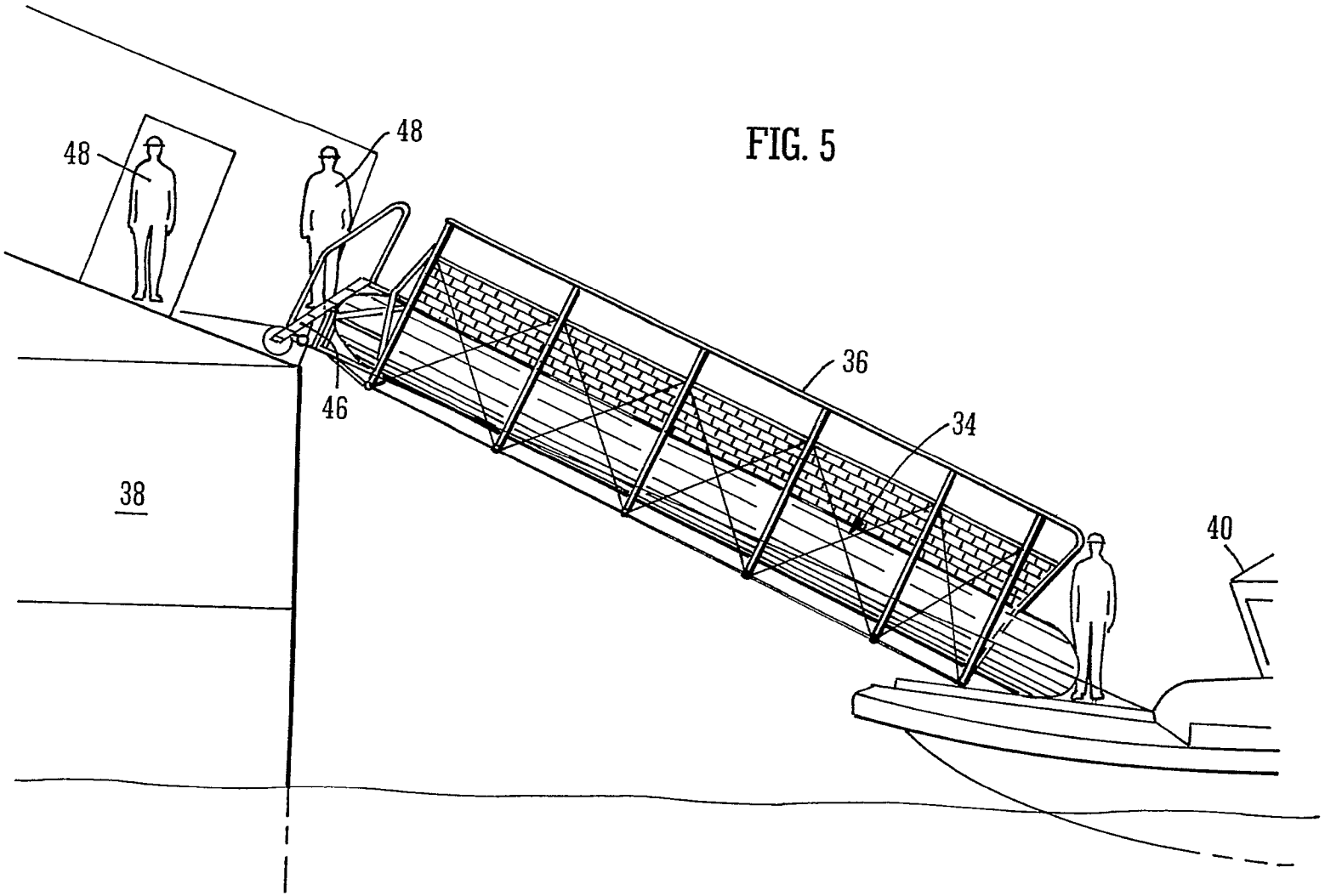
FIG. 5 shows schematically the transfer of personnel using the apparatus of the invention from a barge to a small vessel.

As the cable 42 is pulled by the winch of the smaller vessel 40, the gangway component 16 is drawn down runway 14 against the action of the biasing means 28 until the upper end 18 of the gangway component 16 reaches the lower end of the runway 14, and the gangway component 16 reaches its maximum extension (FIGS. 4A, 4B and 4C). As the gangway component 16 is extended, the counterweight 30 is raised so that a substantially constant load is applied to the smaller boat 40. Typically the load is around 1 kN.

At this stage, preferably temporary fastening means, such as short straps are connected to suitable connections on the deck of the smaller vessel 40. (Where, in alternative arrangements the extended end of the gangway component rests on a fixed structure such as a land based structure (jetty, quay, etc) the temporary fastening means are not required). The smaller boat 40 continues to thrust away from the barge 38, with sufficient thrust to counter the action of the biasing means. The lower end of the runway 14 is provided with end stops and corresponding end stops are provided on the linkage means 22. When the gangway component 16 reaches its maximum extension the end stops of the linkage means 22 contact the end stops of the runway 14. A latch or other suitable locking means is preferably provided to retain the gangway component 16 (via linkage means 22) in its position of maximum extension, and said locking means is activated at this stage. This prevents the gangway component 16 from being pushed or pulled back into the container 12, that is, up the runway 14.

The apparatus 10 is then ready for use. Personnel 48 may walk down or up the gangway component 16. An access door 44 is provided in the side of the container 12 through which personnel 44 may step to and from the barge 38. Steps 46 may be provided to facilitate access onto the gangway component 16.

Figure 6:
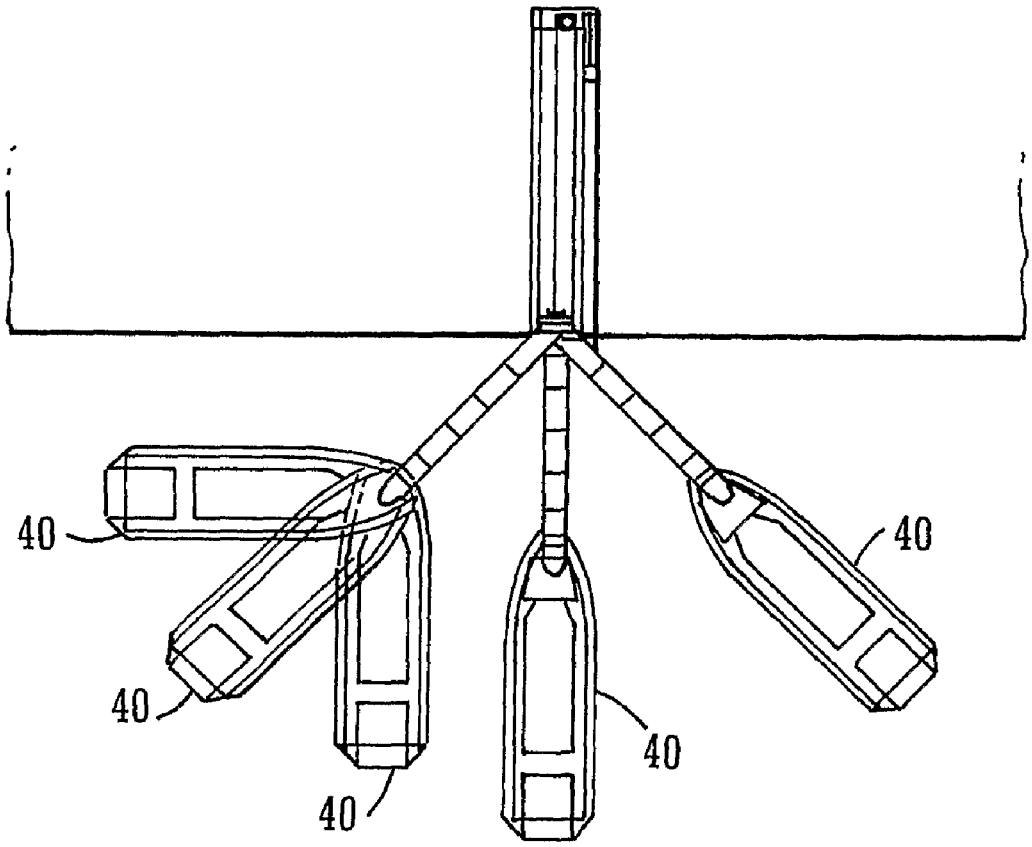
FIG. 6 illustrates schematically a range of headings which the vessel may adopt, in relation to the gangway component of the apparatus of the invention.

FIG. 6 illustrates a range of positions which the gangway component 16 may adopt relative to the smaller vessel 40 and the runway 14. In preferred constructions of the apparatus 10, the gangway component 16 is mounted on the runway 14 (by means of the linkage 22) in such a way that is allowed to rotate about a nominally horizontal axis to accommodate up-and-down movement of the gangway component 16 caused by wave motion. Also, preferably the gangway component 16 is mounted by the linkage 22 in such a way that it can pivot about an approximately vertical axis whereby the smaller vessel 40 is allowed to adopt a range of headings with respect to the runway 14. Preferably also, the connection of the gangway apparatus 16 to the smaller boat 40 is also such as to allow rotational movement of the smaller vessel 40 with respect to the gangway apparatus 16 about one or both of nominally horizontal and approximately vertical axes. This construction allows for movements of the smaller vessel 40 caused by wave motion and also allows for a range of headings to be adopted by the smaller vessel 40 relative to the gangway apparatus 16.

Recovery of the gangway apparatus 16 after use is essentially the reverse of the process as described above. Initially, the temporary securing means which connect the gangway apparatus 16 to the smaller vessel 40 are released. The smaller vessel 40 is then free to move away from the barge 38. At the same time, the gangway apparatus 16 is no longer constrained by the smaller vessel 40 and, after release of the locking means, the counterweight 30 acts to draw the gangway apparatus 16 up the runway 14 into its stored condition within the container 12. Where the runway 14 is upwardly inclined, the gangway component may, of course, return to the stored condition by the action of gravity. Control means may control the motion of the gangway apparatus in this respect, e.g. by applying a braking force if needed, or by assisting the movement of the gangway component. If required, fastening or locking means may be provided to secure the gangway apparatus 16 in its stored position.

The apparatus 10 of the invention has been described above primarily in relation to the transfer of people, goods and equipment to and from a relatively large vessel such as barge 38 from and to a smaller vessel 40. However, the apparatus 10 of the invention is also applicable to the transfer of people, goods and equipment between vessels of comparable size and even between a relatively large vessel (the first marine structure) and a fixed structure such as a quayside (the second marine structure). The principles of operation of the apparatus 10 remain essentially the same in that the apparatus 10 is most preferably provided in a container 12 on the first marine structure and is extended from the first marine structure by drawing the apparatus 10 along (e.g. down or up) runway 14 against or respectively with the action of a biasing means 16. Clearly, where the second marine structure is not a smaller vessel 40, it may not be desirable or possible for the second marine structure to manoeuvre close to the first marine structure and so the first marine structure (e.g. a large vessel) may be required to manoeuvre sufficiently close to the second marine structure (e.g. another large vessel or a quayside) so that the gangway component 16 can span the gap between the first and second marine structures. For transfer between vessels, and especially between relatively large vessels it is advantageous to provide means for limiting the tension in securing means which secure the extended gangway component to the second vessel, so that for example, the securing means may break which the tension is too high. In this case, personnel may remain in safety on the gangway component until connection between the vessels is re-established. Additionally or alternatively, winches may be provided which pay out cable if the vessels move too far apart.

Where, as is preferred, the gangway component 16 is buoyant, important safety features accrue. If, for any reason, the gangway component 16 becomes detached in use from the second marine structure, then the lower end 20 of the gangway component 16 will fall into the water where it will float. Any personnel who happen to be on the gangway component 16 at the time then have the opportunity to climb up the gangway component 16 to regain the first marine structure (e.g. barge 38). Also, the gangway component 16 can be drawn back up the runway 14 by the biasing means 28 while the personnel remain on the gangway component 16. Similarly, if for any reason the gangway component 16 becomes detached in use from the first marine structure, then the upper end 18 of the gangway component 16 will fall into the water where it will float. Any personnel who happen to be on the gangway component 16 at the time then have the opportunity to climb up the gangway component 16 to access the second marine structure. In the unlikely event that the gangway component 16 becomes detached from both the first and second marine structures, then the gangway component 16 floats in the water and provides a refuge for any personnel unfortunate enough be on the gangway component 16, until such time as they can be rescued.

The invention claimed is:

1. Apparatus for providing bridge structure from a first marine structure to a second marine structure, the apparatus comprising:

i) a gangway component having a first end and a second end, the distance between the first and second ends of the gangway being fixed when the gangway is in a use position;

ii) a runway arranged on the first marine structure, the runway engaging the gangway component, the gangway component operatively moveable linearly along the runway between a stored condition and the use condition, the first and second ends being on the runway in the stored condition, the second end extending beyond the runway to the second marine structure and the first end remaining on the runway in the use condition; and iii) control means operative to control the movement of the gangway component to or from the stored condition;

wherein the gangway component is expandable from a compact condition to an extended condition by inflation thereof.

2. Apparatus as claimed in claim 1 wherein the runway is inclined such that the longitudinal axis of the runway is not parallel with respect to the horizontal.

3. Apparatus as claimed in claim 2 wherein the inclination of the runway is such that the gangway component moves downwardly from the stored condition to the use condition.

4. Apparatus as claimed in claim 1 wherein the gangway component is buoyant.

5. Apparatus as claimed in claim 1 wherein the runway engages the gangway such that the entire gangway can pivot horizontally relative to the runway about the engagement between the gangway and runway.

6. Apparatus as claimed in claim 1 wherein the gangway component comprises one or more inflatable members.

7. Apparatus as claimed in claim 6 wherein the gangway component comprises an outer skin enclosing a plurality of inflatable members.

8. Apparatus as claimed in claim 1 further comprising a walkway surface, supported by one or more inflatable members.

9. Apparatus as claimed in claim 1 wherein the control means comprises a biasing means operative to urge the gangway component towards the stored condition.

10. Apparatus as claimed in claim 9 wherein the biasing means comprises a counterweight attached to the first end of the gangway component which is an upper end of the gangway component when in the stored condition.

11. Apparatus as claimed in claim 1 further comprising a fastening means for temporarily fastening the gangway component to the second marine structure.

12. Apparatus as claimed in claim 1 further comprising a container within which at least the gangway component and the control means are mounted.

13. Apparatus as claimed in claim 12 wherein the entirety of the runway is mounted within the container.

14. Apparatus as claimed in claim 12 wherein the container comprises an ISO Standard shipping container.

15. A vessel having mounted thereon an apparatus as claimed in claim 1.

16. Apparatus as claimed in claim 1 when mounted on land or on a fixed offshore structure.

17. Apparatus as claimed in claim 1 wherein the runway is inclined at an angle of from 10° to 30°.

18. A method of providing access for the transfer of personnel, goods or equipment from a first marine structure to a second marine structure, the method comprising:

providing an apparatus as claimed in claim 1 mounted on the first marine structure;

moving the gangway component along the runway in a direction parallel to the longitudinal axis of the gangway component from the stored condition to the use condition so that the gangway component spans the gap between the first and second marine structures; and if necessary, securing the gangway component in the extended position.

19. A method as claimed in claim 18 further comprising fastening the extended end of the gangway component to the second marine structure.

20. A method as claimed in claim 18 further comprising:

providing a winch on the second marine structure, attaching the gangway component to the winch, and using the winch to move the gangway component along the runway.

* * * * *